US008406651B2

(12) United States Patent
Selinger et al.

(10) Patent No.: US 8,406,651 B2
(45) Date of Patent: Mar. 26, 2013

(54) APPARATUS AND METHOD FOR REMOVING TONER DEPOSITS FROM THE SURFACE OF A CLEANING ELEMENT

(75) Inventors: Ralf Selinger, München (DE); Robert Link, Poing (DE); Admir Lela, Haar (DE)

(73) Assignee: Océ Printing Systems GmbH, Poing (DE)

( * ) Notice: Subject to any disclaimer, the term of this patent is extended or adjusted under 35 U.S.C. 154(b) by 542 days.

(21) Appl. No.: 12/670,808

(22) PCT Filed: Jul. 31, 2008

(86) PCT No.: PCT/EP2008/060063

§ 371 (c)(1),
(2), (4) Date: Jan. 26, 2010

(87) PCT Pub. No.: WO2009/016233

PCT Pub. Date: Feb. 5, 2009

(65) Prior Publication Data

US 2010/0226703 A1 Sep. 9, 2010

(30) Foreign Application Priority Data

Aug. 1, 2007 (DE) ..... 10 2007 035 994

(51) Int. Cl.
*G03G 21/00* (2006.01)
*G03G 15/08* (2006.01)

(52) U.S. Cl. ..... 399/99; 399/283

(58) Field of Classification Search ..... 399/358, 399/357, 271, 273, 353, 283, 356, 99, 264
See application file for complete search history.

(56) References Cited

U.S. PATENT DOCUMENTS 4,588,285 A * 5/1986 Tagoku ..... 399/354
(Continued)

FOREIGN PATENT DOCUMENTS

DE 101 52 892 5/2003
DE 10 2004 059 532 6/2006
(Continued)

OTHER PUBLICATIONS

Merriam-Websters's Collegiate Dictionary, 10th ed. 1998: definitions of "device" and "mechanism".*

*Primary Examiner* — David Gray
*Assistant Examiner* — Sevan A Aydin
(74) *Attorney, Agent, or Firm* — Schiff Hardin LLP

(57) ABSTRACT

In a method to remove toner deposits on a surface of a cleaning element, electrically charged toner particles are transferred from a transfer element surface to a photoconductor. On the cleaning element, untransferred, electrically charged toner particles as residual toner from the transfer element surface are received. Electrically charged toner particles on the cleaning element are directed past an electrode arrangement arranged at a distance from the surface of the cleaning element. An alternating electrical field is generated which acts on the toner particles to loosen them. The toner particles remaining on the surface of the cleaning element are brought into contact with a mixture of carrier particles and toner particles during further transport along a transport direction of the cleaning element.

13 Claims, 3 Drawing Sheets

U.S. PATENT DOCUMENTS

| | | | | |
|---|---|---|---|---|
| 5,311,258 | A | 5/1994 | Brewington et al. | |
| 6,398,345 | B1 | 6/2002 | Sakai et al. | |
| 6,449,448 | B2 | 9/2002 | Bessho et al. | |
| 7,340,203 | B2 | 3/2008 | Höllig et al. | |
| 7,583,918 | B2 | 9/2009 | Samweber | |
| 2005/0036806 | A1 * | 2/2005 | Hollig et al. | 399/273 |

FOREIGN PATENT DOCUMENTS

| | | |
|---|---|---|
| DE | 10 2007 019 311 | 11/2008 |
| EP | 1 115 038 | 7/2001 |
| WO | WO 03/036393 | 5/2003 |

* cited by examiner

APPARATUS AND METHOD FOR REMOVING TONER DEPOSITS FROM THE SURFACE OF A CLEANING ELEMENT

BACKGROUND

The preferred embodiment concerns a method to remove toner deposits on the surface of a cleaning element which accepts electrically charged toner particles from a carrier surface. The preferred embodiment also concerns a device to remove toner deposits on the surface of a cleaning element.

In electrographic printers or copiers, image development methods are used that ink electrostatic charge images on intermediate carrier surfaces (for example charge images on a photoconductor or a photoconductor belt) across an air gap or in direct contact with triboelectrically charged toner particles that are transferred from the surface and applicator element. After the transfer of the toner particles from the applicator element onto the surface of the intermediate carrier, the surface of the applicator element must be cleaned of the remaining untransferred toner particles by a cleaning element, generally by a cleaning roller. The electrically charged toner particles taken up by the cleaning element (which is charged with a predetermined electrical potential) can consolidate as a result of electrical adhesion forces, heat, friction or pressure and lead to a film formation or to caking on the surface. The surface of the cleaning element can thereby be negatively affected in terms of its cleaning function and make the entire printing process unstable. If the fixed deposits on the surface of the cleaning element detach as clumps or fragments, this can lead to the degradation of the function of the developer station (for example insufficient inking) and even damage to it (for example by scratching the surface).

A device to clean an electrode arrangement that comprises a plurality of electrodes which are arranged around small through holes is known from U.S. Pat. No. 6,398,345 B1. With the aid of a control voltage applied to the electrodes, toner particles are let through the through holes or the through holes are blocked so that toner material can be graphically applied to a substrate material present after the electrode arrangement. Toner particles straying about can deposit on the stationary electrode arrangement and plug the through holes. Therefore, between the printing processes a movably borne cleaning device is moved towards the electrode arrangement that detaches and removes the toner particles without contact. For this the device comprises a suction nozzle whose opening is surrounded by an electrode that is charged with voltage. The toner particles are detached from the electrode arrangement with the aid of the electrical fields generated via the voltage and drawn off by the suction nozzle. After detaching the toner particles, the device is removed again in order to be able to continue the printing process.

A device and a method to clean a surface provided with toner particles is proposed in DE 10 2007 019 311 (previously unpublished) by the same applicant. A cleaning roller charged with electrical potential receives electrically charged toner particles from the substrate surface of an applicator element. The toner particles are resupplied to the mixture made up of toner particles and carrier particles and reused. The disclosure content of the aforementioned Patent Application is herewith incorporated by direct reference into the present Application.

Furthermore, reference is made to the prior art according to the documents DE 10 2004 059 532 A1, U.S. Pat. No. 5,311, 258 A and DE 101 52 892 A1.

SUMMARY

It is an object to specify a method and a device to remove toner deposits on the surface of a cleaning element which are of simple design and operate reliably.

In a method to remove toner deposits on a surface of a cleaning element, electrically charged toner particles are transferred from a transfer element surface to a photoconductor. On the cleaning element, untransferred, electrically charged toner particles as residual toner from the transfer element surface are received. Electrically charged toner particles on the cleaning element are directed past an electrode arrangement arranged at a distance from the surface of the cleaning element. An alternating electrical field is generated which acts on the toner particles to loosen them. The toner particles remaining on the surface of the cleaning element are brought into contact with a mixture of carrier particles and toner particles during further transport along a transport direction of the cleaning element.

DESCRIPTION OF THE PREFERRED EMBODIMENTS

Figure 1:
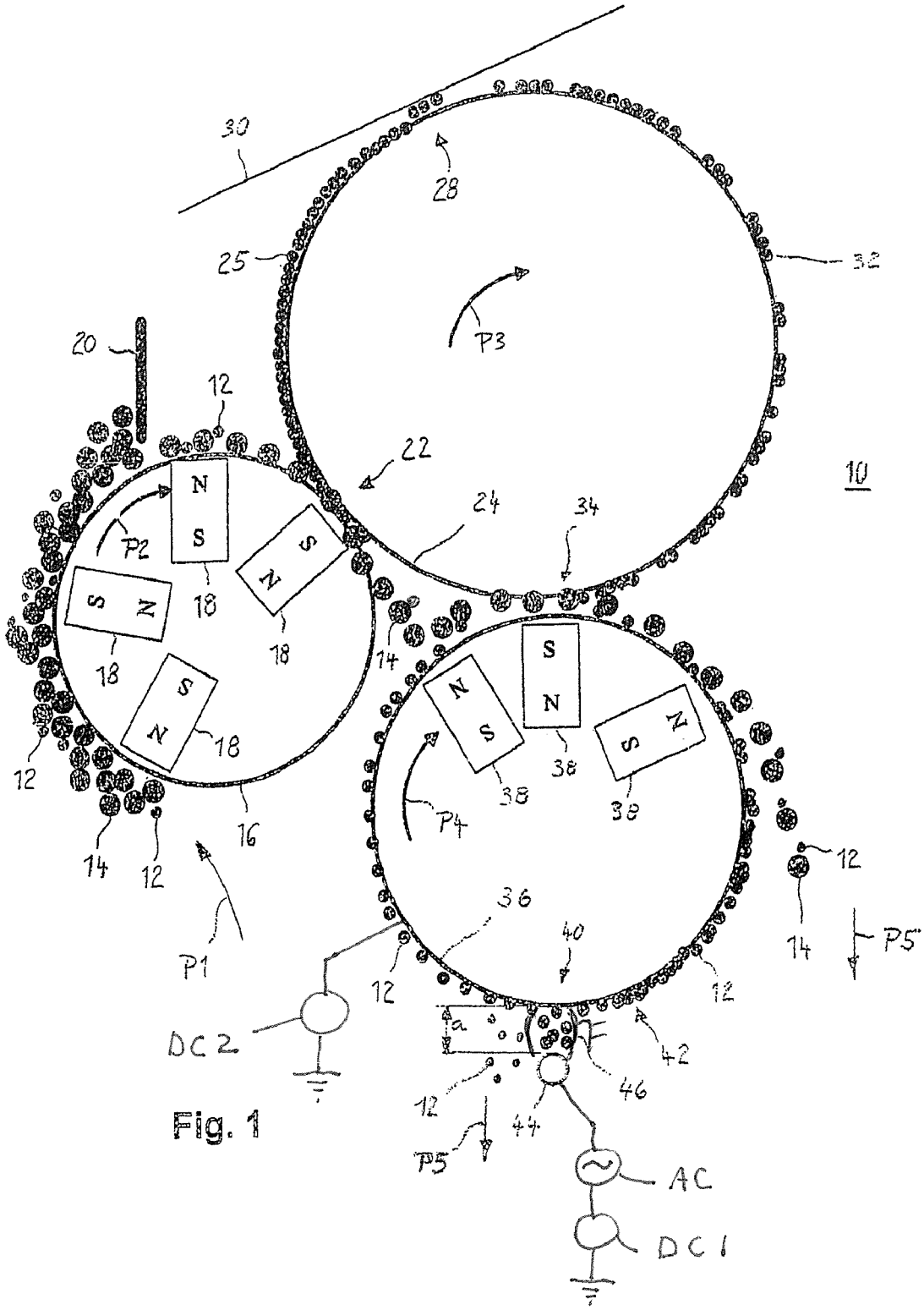
FIG. 1 is a developer station with a cleaning roller that comprises an electrode arrangement in an activation zone.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and method, and such further applications of the principles of the invention as illustrated as would normally occur to one skilled in the art to which the invention relates are included.

In the invention, the electrically charged toner particles on the surface of the cleaning element are directed past an electrode arrangement that generates an alternating electrical field. This alternating field acts on the electrically charged toner particles. Due to the alternating electrical field with the electrical charge of the toner particles, a movement force is generated in the alternating electrical field so that toner particles are moved back and forth. Free toner particles that are not adhering jump back and forth in the alternating field and can strike other, firmly adhering toner particles on the surface of the cleaning element that are thereby mechanically loosened and detached. Compacted toner particles on the surface of the cleaning element are thus loosened and their adhesion force on the surface is reduced. The loosened toner particles of the toner remaining on the cleaning element, together with carrier particles, then form into a magnetic brush with which the carrier surface (for example of a jump roller) is cleaned.

After the further movement of the cleaning element past the electrode arrangement, depending on the polarity of the alternating field and the charge of the toner particles relative to the potential of the surface of the cleaning element, the toner particles are drawn towards or repelled from this surface. Repelled toner particles are immediately resupplied to the mixture made up of carrier particles and toner particles in the developer station. Toner particles attracted by the surface deposit loosely on the surface of the cleaning element. During further transport along the transport direction of the cleaning element these loose toner particles are brought into the range of influence of carrier particles, whereby the toner particles are electrically attracted by the carrier particles.

The operating method works without contact and in a protective manner for the surface of the cleaning element because a mechanical abrasion or removal of the fixed deposits is avoided. It also works in a protective and mechanically low-stress manner for the resupplied toner particles because the fixed deposits are loosened by other toner particles in the alternating field so that a clump formation or a formation of fragments is largely avoided.

According to a further aspect of the preferred embodiment, a device is specified for the removal of toner deposits on the surface of a cleaning element. The technical advantages that can be achieved with this device coincide with those that have been described in connection with the method.

Exemplary embodiments are described in detail in the following using the schematic drawings.

FIG. 1 shows an exemplary embodiment for a developer device 10 in which a mixture made up of electrically charged toner particles 12 and ferromagnetic carrier particles 14 is used. The toner particles 12 are represented as small spheres and the carrier particles 14 are represented as larger spheres. The mixture is offered to an inking roller 16 in the direction of the arrow P1 with the aid of a circulating roller (not shown).

Stationary, oblong magnet elements 18 whose externally directed poles (as viewed in the circumferential direction) alternate in the shown variant are arranged inside the rotatable, hollow inking roller 16. The carrier particles 14 are arranged and aligned along the magnetic field lines on every magnet element 18 by the force effect of the magnetic field, wherein an accumulation of carrier particles 14 and the toner particles 12 adhering to them, which accumulation sticks out from the surface, arises on the surface of the inking roller 16 in the region of the outwardly pointing poles of the magnet elements 18. Such an accumulation of carrier particles 14 and toner particles 12 that stands out is designated as a magnetic brush due to the brush-like design. The toner particles 12 are triboelectrically charged by the circulation process and generally have a negative electrical charge. They adhere to the carrier particles 14 and, due to the rotating sleeve of the inking roller 16, are transported along with this in the direction of the arrow P2.

A dosing blade 20 generates a uniformly high layer of the mixture on the outer surface of the inking roller 16. This uniform layer is brought via rotation of the inking roller 16 into an inking zone 22 where, due to a potential difference between inking roller 16 and transfer roller 24 as a transfer element, the toner particles 12 are transferred onto the surface of the transfer roller 24 under the effect of the electrical field. The toner particles 12 deposit there on the surface in a uniformly homogeneous layer 25. Given rotation in the direction of the arrow P3 the transfer roller 24 is brought into a transfer zone 28 in which the uniform toner layer 25 is directed past an intermediate carrier 30, for example in electrography a photoconductor in the form of a continuous photoconductor belt. Toner particles 12 are transferred across an air gap under the effect of the electrical field onto the intermediate carrier 30 according to the graphical distribution corresponding to the latent charge image of the intermediate carrier 30. This process, in which the toner particles 12 jump from the transfer roller 24 onto the intermediate carrier 30, is also designated as a jump process. The transfer roller 24 is therefore also designated as a jump roller.

The toner particles 12 that do not transfer onto the intermediate carrier 30, what is known as the residual toner 32, form the image negative of the latent charge image on the intermediate carrier 30 and must be removed from the transfer roller 24. The residual toner 32 is removed in a cleaning zone 34 with the aid of a cleaning roller 36 as a cleaning element.

Inside the cleaning roller 36, as in the inking roller 16 magnetic elements 38 are arranged that have the same function as in the inking roller 16 and form a magnetic brush with the aid of the magnetic carrier particles 14. As is seen in FIG. 1, given the rotation of the cleaning roller 36 in the direction P4 the carrier particles 14 are transported from the inking zone 22 to the cleaning zone 34. The toner particles 12 accept these carrier particles 14 from the surface of the transfer roller 24. Given rotation of the cleaning roller 36 in the direction of the arrow P4, the carrier particles 14 are transported on together with the toner particle 12. The toner particles 12 adhere to the carrier particles 14. This mixture detaches from the surface of the cleaning roller 36 when it leaves the magnetic field of the magnet elements 38 and falls in the direction of the arrow P5 back into a developer chamber, and is stirred together with toner particles and carrier particles located there again.

Due to their electrical charge and the effect of the surface forces, multiple toner particles 12 remain on the surface of the cleaning roller 36 that is charged with a direct voltage potential, adhere and are transported into an activation zone 40. As a result of adhesion forces, heat, pressure and/or aging, these toner particles 12 can consequently form a solid accumulation or deposit 42 which adheres relatively firmly to the surface of the cleaning roller 36. Toner films or cakes can thus form on the surface of the cleaning roller 36, which films or cakes can become increasingly voluminous in the further course of the process and multiple rotations of the cleaning roller 36. If these fixed accumulations 42 are not removed, these can lead to print image interference or overall to system disruptions. The removal of the accumulation 42 with the aid of mechanical elements (for example a blade) is problematical since the toner material and/or the surface of the cleaning roller 36 can hereby be damaged.

An electrode arrangement 44 that is charged with an alternating voltage AC is positioned in the region of the activation zone 40. A direct voltage DC1 is advantageously overlaid on this alternating voltage AC. The alternating voltage lies in the range from 200 to 3000 Vss (measured peak to peak), in particular in the range of 1500 to 2500 Vss at a frequency from 1 to 10 kHz, in particular in a range from 2 to 5 kHz. The direct voltage can be in a range from 0 to 2000 V, in particular in a range from 200 V to 900 V. The distance a between the surface of the cleaning roller 36 and the electrode arrangement 44 lies in a range from 0.05 to 2 mm, in particular in a range from 0.1 to 0.5 mm. The cleaning roller 36 is charged with a direct voltage DC2 that is in the range from 0 to 2000 V, in particular 200 V to 900 V. The transfer roller is charged with a direct voltage that is in the range from −1000 V to +500 V, in particular in the range from −500 V to 0 V. The inking roller 16 has a direct voltage potential in the range from −3000 V to +1000 V, in particular from −2000 V to 0 V. The direct voltages are selected so that the toner particles 12 are safely transferred from the inking roller 16 to the transfer roller 24, from there to the intermediate carrier 30 and to the cleaning roller 36 under the effect of the resulting electrical force field.

The electrode arrangement 44 generates an electrical field F which in its near field 46 acts on the toner particles 12 situated opposite said electrode arrangement 44. Due to the alternating electrical field forces, the electrically charged toner particles 12 are loosened from the surface of the cleaning roller 36 and moved back again. In the near field 46 of the electrode arrangement 44, i.e. in the region between the electrode arrangement 44 and the surface of the cleaning roller 36 (that forms the counter-electrode) situated directly opposite it, additional toner particles 12 are detached like an avalanche by the jumping of the toner particles 12 back and forth between electrode arrangement 44 and surface of the cleaning roller 36. Even firmly attached toner particles 12 are consequently loosened in the activation zone 40. Given a further rotation of the cleaning roller 36 in the direction P4, the loosened toner particles 12 leave the near region 46 of the alternating electrical field. Depending on the momentary direction of the alternating field, the charge of the respective loosened toner particle 12 and the potential of the surface of the cleaning roller 36, some toner particles 12 are not moved back to the surface of the cleaning roller 36 but rather fall down in the direction P5 as a result of gravity and mix with the mixture made up of carrier particles 14 and toner particles 12. The toner particles 12 remaining on the surface of the cleaning roller 36 are loosened and transported on.

Carrier particles 14 are supplied to the cleaning roller 36 via the inking roller 16. These carrier particles 14 attract the toner particles 12 and convey these further into the region of the magnets 38. In this way the loosely adhering toner particles 12 are resupplied to the mixture made up of carrier particles 14 and toner particles 12. The transport of the carrier particles 14 occurs in the direction opposite the surface speed of the transfer roller 24. The magnetic brush forming in the region of the magnets 38 takes the residual toner 32 along in the direction P4 of the cleaning roller 36.

Figure 2:
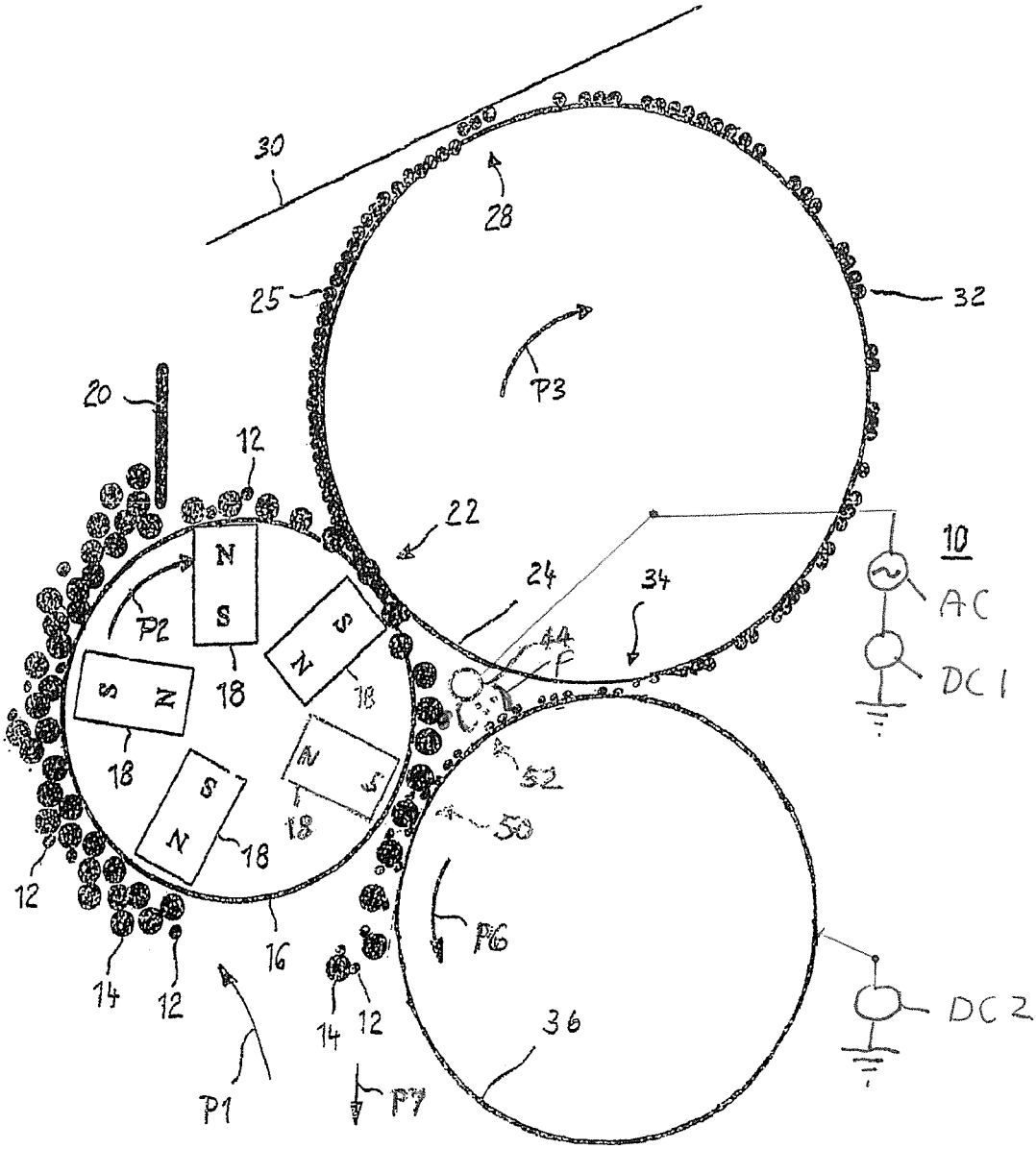
FIG. 2 is an additional example in which the cleaning roller in the same cleaning zone has the same movement direction as an applicator roller.

FIG. 2 shows a further exemplary embodiment in which the cleaning roller 36 executes a rotation movement according to the arrow P6 in which the surface of the transfer roller 24 and the cleaning roller 36 move in the same direction in the cleaning zone 34. The cleaning roller 36 itself contains no stationary magnetic elements. The transfer of the toner particles 12 from the transfer roller 24 to the cleaning roller 36 in the cleaning zone occurs via a jump process, wherein the direct voltage potentials required for the electrical force field are to be set accordingly. The inking roller 16 furthermore contains the stationary magnetic elements 18, wherein a magnetic element 18 is also arranged in the region of a zone 50 so that a magnet brush also forms in this region. The mixture made up of toner particles 12 and magnetic carrier particles 14 is accordingly also transported into the region of the zone 50 in the form of a magnetic brush. The electrode arrangement 44 that, as in the exemplary embodiment according to FIG. 1, loosens in the field F fixed toner accumulations on the surface of the cleaning roller 36 is provided in an activation zone 52 before this zone 50. The loosened toner particles that are carried along by the carrier particles 14 then lie on the surface of the cleaning roller 36 in the region of the zone 50. After rotation, in a region in which a magnetic field of the magnetic elements 18 is no longer effective the carrier particles 14 and the toner particles 12 adhering to them then leave the inking roller 16 in the direction of the arrow P7 and are stirred with the toner mixture in the developer chamber.

Figure 3:
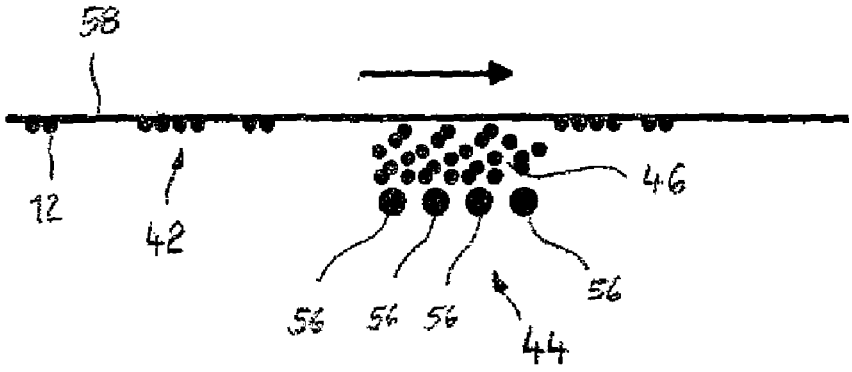
FIG. 3 shows an electrode arrangement with multiple wire-shaped elements.

FIG. 3 shows an electrode arrangement 44 in which a plurality of electrode wires 56 is arranged perpendicular to the paper plane so that the alternating electrical field is formed between the electrode wires 56 and the surface 58. The space of the near field 46 in which the alternating electrical field is particularly effective is enlarged by this arrangement. The surface 58 which bears the toner particles 12 or, respectively, the accumulation 42 is flat in this example, formed by a cleaning belt, for example.

Figure 4:
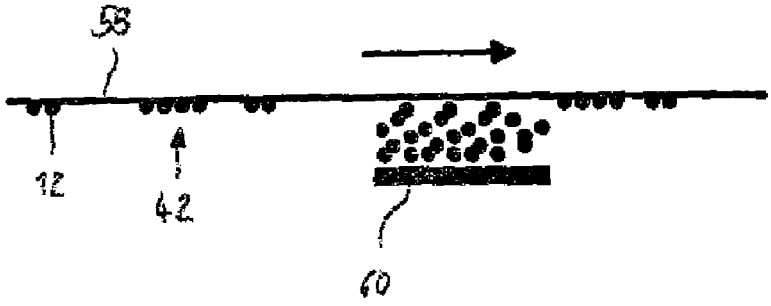
FIG. 4 illustrates a plate-shaped electrode arrangement.

FIG. 4 shows plate-shaped electrode arrangement 60 which likewise faces a flat surface 58.

In order to reduce the flash-over danger between the surface of the cleaning roller 36 and the electrode arrangement 44, the electrode arrangement 44 can be provided with a surface having an electrical resistance. This can advantageously occur with the aid of a hard coat layer or with the aid of a ceramic layer, for example $Al_2O_3$, $Cr_2O_3$.

A square voltage with variable duty factor can also be used as an alternating voltage. The movement of the toner particles 12 between the electrode arrangement 44 and the surface of the cleaning roller 36 can thereby be influenced. For example, the residence duration of the toner particles 12 on the side of the electrode arrangement 44 or on the side of the cleaning roller 36 can be adjusted in a specific manner.

A cleaning belt can also be used instead of a cleaning roller.

As has been shown using the examples, a method and the device is described in which toner particles on a surface are gently loosened and mobilized with the aid of electrical field forces. Cakes or consolidations of the toner particles thus do not occur in the further process, and the toner particles remain available to the further process in largely unchanged form. Consolidations of the toner particles among one another and/or of the toner particles with the occupied surface are avoided with the aid of the mobilization and the activation of the toner particles. Downstream devices then make do with significantly smaller mechanical forces in order to detach the toner coating and to return the toner particles to the developer process. Both the toner particles and the toner-coated surfaces are thereby protected. The service life of the element occupied with toner particles (for example the cleaning roller or the cleaning belt) is markedly increased in this way. The gentle treatment of the toner particles has the result that the entirety of the toner material in the development process is altered only slightly, whereby a stabilization of the entire development process is achieved.

Although preferred exemplary embodiments have been shown and described in detail in the drawings and in the preceding specification, they should be viewed as merely exemplary and not as limiting the invention. It is noted that only the preferred exemplary embodiments are presented and described, and all variations and modifications that presently and in the future lie within the protective scope of the invention should be protected.

The invention claimed is:

1. A method to remove toner deposits on a surface of a cleaning element, comprising the steps of:

transferring electrically charged toner particles from a transfer element surface to a photoconductor;

receiving on the cleaning element untransferred, electrically charged toner particles as residual toner from the transfer element surface;

thereafter directing the electrically charged toner particles on the cleaning element past an electrode arrangement that is arranged at a distance from the surface of the cleaning element and generating an alternating electrical field which acts on the toner particles such that they are loosened; and bringing the loosened toner particles remaining on the surface of the cleaning element into contact with a mixture made up of carrier particles and toner particles during further transport along a transport direction of the cleaning element.

2. The method according to claim 1 in which the cleaning element is charged with a direct voltage such that the toner particles adhere to its surface.

3. The method according to claim 1 in which the mixture made up of the carrier particles and the toner particles is directed between the transfer element surface and the cleaning element in a region of a cleaning zone.

4. The method according to claim 3 in which magnetic fields which form a magnetic brush in the mixture made up of the carrier particles and the toner particles are effective as said magnetic brush in the region of the cleaning zone.

5. The method according to claim 3 in which the surface of the cleaning element and the transfer element surface move in opposite directions in the cleaning zone.

6. The method according to claim 3 in which the surface of the cleaning element and the transfer element surface move in a same direction in the cleaning zone.

7. The method according to claim 6 in which the mixture made up of the carrier particles and the toner particles is directed from an inking roller into a zone in which the inking roller and the surface of the cleaning element face one another, and wherein the mixture made up of the carrier particles and the toner particles accepts the loosened toner particles on the surface of the cleaning element.

8. The method according to claim 1 in which the toner particles received from the cleaning element are resupplied to the mixture made up of the carrier particles and the toner particles of a developer unit.

9. A device to remove toner deposits on a surface of a cleaning element, comprising:

a transfer element surface which transfers electrically charged toner particles onto a photoconductor;

the cleaning element receiving untransferred, electrically charged toner particles as residual toner from the transfer element surface;

the cleaning element directing the electrically charged toner particles past an electrode arrangement that is arranged at a distance from the surface of the cleaning element and which generates an alternating electrical field which acts on the toner particles to loosen them; and the cleaning element bringing the toner particles remaining on the surface of the cleaning element into contact with a mixture made up of carrier particles and toner particles during further transport by the cleaning element.

10. The device according to claim 9 in which magnetic fields which form a magnetic brush in the mixture made up of the carrier particles and the toner particles are effective as said magnetic brush in a region of a cleaning zone.

11. The device according to claim 9 in which an inking roller transports the mixture made up of the carrier particles and the toner particles into a zone in which the inking roller and the surface of the cleaning element face one another, wherein the mixture made up of the carrier particles and the toner particles receive the loosened toner particles on the surface of the cleaning element.

12. The device according to claim 9 in which the toner particles received by the cleaning element are resupplied to the mixture made up of the carrier particles and the toner particles of a developer unit.

13. A method to remove toner deposits on a surface of a cleaning element, comprising the steps of:

transferring electrically charged toner particles from a transfer element surface to a photoconductor carrier;

receiving on the cleaning element untransferred, electrically charged toner particles as residual toner from the transfer element surface;

thereafter directing the electrically charged toner particles on the cleaning element past an electrode arrangement that is arranged at a distance from the surface of the cleaning element and generating an alternating electrical field which acts on the toner particles such that they are loosened; and bringing the loosened toner particles remaining on the surface of the cleaning element into contact with a mixture made up of carrier particles and toner particles during further transport.

* * * * *